United States Patent [19]

Honda et al.

[11] Patent Number: 4,797,327

[45] Date of Patent: Jan. 10, 1989

[54] SURFACE TREATED METAL MEMBER, PREPARATION METHOD THEREOF AND PHOTOCONDUCTIVE MEMBER BY USE THEREOF

[75] Inventors: Mitsuru Honda, Kashiwa; Tetsuo Sueda, Chofu; Keiichi Murai, Kashiwa; Kyosuke Ogawa, Nabari, all of Japan

[73] Assignee: Canon Kabushiki Kaisha, Tokyo, Japan

[21] Appl. No.: 74,890

[22] Filed: Jul. 17, 1987

Related U.S. Application Data

[62] Division of Ser. No. 847,449, Apr. 3, 1986, Pat. No. 4,735,883.

[30] Foreign Application Priority Data

| | | | |
|---|---|---|---|
| Apr. 6, 1985 | [JP] | Japan | 60-73171 |
| May 8, 1985 | [JP] | Japan | 60-98601 |
| May 8, 1985 | [JP] | Japan | 60-98602 |
| May 8, 1985 | [JP] | Japan | 60-98603 |

[51] Int. Cl.[4] ..... G03G 15/00

[52] U.S. Cl. ..... 428/600; 428/687; 428/925

[58] Field of Search ..... 72/53; 425/687, 600, 425/601, 923, 925; 29/DIG. 36

[56] References Cited

U.S. PATENT DOCUMENTS

| | | | |
|---|---|---|---|
| 487,121 | 11/1892 | Haggermuller | 428/687 |
| 1,784,866 | 12/1930 | Fahrenwald | 29/121.1 |
| 2,440,963 | 5/1948 | Luce | 72/53 |
| 3,310,860 | 3/1967 | Gronholz et al. | 29/184 D |
| 4,250,726 | 2/1981 | Safian et al. | 72/53 |
| 4,258,084 | 3/1981 | Hayden | 72/53 |
| 4,329,862 | 5/1982 | Harburn et al. | 72/53 |
| 4,405,703 | 9/1983 | Onuma et al. | 430/69 |
| 4,432,220 | 2/1984 | Loersch et al. | 72/53 |

FOREIGN PATENT DOCUMENTS

| | | | |
|---|---|---|---|
| 2438507 | 5/1980 | France . | |
| 184625 | 9/1985 | Japan | 72/53 |
| 1320748 | 6/1973 | United Kingdom | 72/53 |

OTHER PUBLICATIONS

M. Woelfel et al., "Glass Bead Impact Blasting", Metal Progress, Sep. 1982, vol. 122, No. 4, pp. 57–59.

*Primary Examiner*—John J. Zimmerman

*Attorney, Agent, or Firm*—Fitzpatrick, Cella, Harper & Scinto

[57] ABSTRACT

A surface treated metal member comprises a metal member having unevenness with a plurality of spherical mark impressions formed on the surface.

6 Claims, 5 Drawing Sheets

SURFACE TREATED METAL MEMBER, PREPARATION METHOD THEREOF AND PHOTOCONDUCTIVE MEMBER BY USE THEREOF

This is a division of application Ser. No. 847,449, filed Apr. 3, 1986 now U.S. Pat. No. 4,735,883.

BACKGROUND OF THE INVENTION

1. Field of the invention

This invention relates to a constituent member for electrical or electronic devices, particularly a surface treated metal member utilizable as the substrate for a photoconductive member such as electrophotographic photosensitive member, etc., a method for preparing the same and a photoconductive member by use of the surface treated metal member 2. Related Background Art The surface of a metal member is applied with various cutting or grinding working in order to impart a surface shape corresponding to the use.

For example, as the substrate (support) for a photoconductive member such as electrophotographic photosensitive member, etc , a metal member shaped in plate, cylinder, endless belt, etc., is used and, for formation of a photoconductive layer, etc., on the support, its surface is finished such as by mirror-finishing, cutting working, etc., for example, by diamond bit cutting with the use of a lathe, a milling machine, etc., and it is worked to a flatness within a predetermined range or, in some cases, finished to an uneven surface with a predetermined shape or any desired shape for prevention of interference fringe.

When such a surface is formed by cutting, the bit may come against fine intervening matters such as rigid alloy components, oxide, etc., or blisters existing near the surface of the metal member, whereby inconveniences may occur such that workability of cutting is lowered and also the surface defects caused by the intervening matters, etc., are liable to appear by cutting. For example, when an aluminum alloy is used as the metal member to be used for the support, there exist in the aluminum structure hard intervening matters such as intermetallic compounds of Si-Al-Fe type, Fe-Al type, $TiB_2$, etc., and oxides of Al, Mg, Ti, Si, Fe and blisters due to $H_2$ and at the same time also there occur the surface defect such as grain boundary stepped difference arising between the adjacent Al structures with different crystallization orientations. When, for example, an electrophotographic photosensitive member is constituted of a support having such a surface defect, uniformity in film formation becomes worse, leading further to impairment of uniformity in electrical, optical and photoconductive characteristics, whereby no beautiful image can be provided and the photosensitive member becomes practically useless.

Also, according to cutting, there will ensue other problems such as generation of cutting powder or consumption of cutting oil, cumbersomeness in disposal of cutting powder, treatment of the cutting oil remaining on the cut surface, etc.

As an alternative method, to control flatness or surface coarseness of the surface of a metal member, means to cause plastic deformation such as sand blasting or shot blasting in the prior art, but it is not possible to control accurately the shape, precision, etc., of the unevenness imparted onto the surface of the metal member.

On the other hand, as the material for a photoconductive layer, various organic or inorganic photoconductive substances have been employed. For example, an amorphous silicon having its dangling bonds modified with monovalent elements such as hydrogen or halogen (hereinafter called a-Si(H,X)) is often employed as the material for a photoconductive layer due to its excellent photoconductivity, frictional resistance and heat resistance. For making this a-Si(H,X) practically useful, it is required to be constituted of multiple layers depending on the purposed use and may include injection preventing layer which prevents injection of charges from the support, a surface protective layer such as $SiN_X$, $SiC_X$, etc., in addition to the photoconductive layer of a-Si(H,X). Also, the uniformity in the photoconductive member is very important and, if there exist nonuniformity in the photoconductive characteristics due to a defect such as pinholes, not only can beautiful images not be provided, but also the photoconductive member becomes practically useless.

Particularly, it has been known that the form of the film of a-Si(H,X) is greatly influenced by the surface shape of the support. Above all, in an electrophotographic photosensitive drum with a large area for which substantially uniform photoconductive characteristics are required in most portions, the surface condition of the support is very important. Presence of a defect on the support surface will decrease the uniformity of the film so as to form pillar-shaped structures or spherical projections, whereby nonuniformity in photoconductivity may be caused.

Accordingly, when employing a tubular material (cylinder), etc., of an aluminum alloy as the support, various precise cutting or grinding working such as mirror finishing, emboss finishing, etc., are applied on its surface. During such a process, the so-called intergranular stepped difference may be created due to the difference in deformation and restoration by the stress received during working because of the difference in crystal orientation among various kinds of crystal grains sectioned by grain boundaries, whereby defective portions may be formed on the cylinder surface. For example, unevenness with a depth of about 100 to 1000 Å may be formed on the cylinder surface, or alternatively defects such as cracks may be formed along the grain boundaries to generate numerous pillar-shaped structures or cone-shaped spherical projections on the grain boundaries, whereby photoconductive nonuniformity or abnormality in photoconductive characteristic will be increased. Further, crystal grains with greater sizes can poorly disperse the stress created during working with the result that a greater grain boundary stepped difference will be created.

Further, in the process of applying various cutting or grinding working as described above, if there exists a hard portion, called a hard spot, due to various intervening matters as described above, in the mirror finishing process such as by cutting working, it becomes a cutting resistance against the cutting bit to cause formation of a defective portion on the surface of the aluminum cylinder, thus resulting in generation of cracks of about 1 to 10 $\mu$m, gouge-like scars, further fine unevenness, or streak-shaped flaws.

However, in the prior art in order to minimize intervening matters or blisters due to $H_2$ gas, it has been required to use an aluminum alloy base material applied with various countermeasures. Therefore, addition of working steps and increase of cost caused by application of these countermeasures could not be avoided.

Further, electrophotographic photosensitive members receive sliding friction repeatedly with a blade, fur brush, etc., for removal of residual toner. During this operation, durability of the photosensitive member can be improved by increasing the hardness of the support simultaneously with improveing the abrasion resistance of the surface of the photoconductive layer, and there was an example in which a high hardness Al material, etc., was used (for example, Japanese Laid-open Patent Application No. 111046/1981). However, as mentioned previously, particularly in an a-Si photosensitive member there was involved a problem by the precipitate in the Al structure, which was particularly marked in a highly concentrated Si type Al alloy.

SUMMARY OF THE INVENTION

A first object of the present invention is to provide a surface treated metal member to which surface finishing or a surface unevenness was imparted according to a novel method.

A second object of the present invention is to provide a surface treated metal member which has been subjected to surface treatment without accompaniment of cutting working, etc., which is liable to cause formation of surface defects to impair desired use characteristics.

A third object of the present invention is to provide a method for preparing a surface treated metal member which can finish the surface of a metal member to a mirror surface or non-mirror surface of a desired degree or impart unevenness of a desired shape to the surface of a metal member.

A fourth object of the present invention is to provide a photoconductive member excellent in uniformity in film formation as well as uniformity in electrical, optical and photoconductive characteristics by use of a surface treated metal member applied with desired surface finishing or impartment of surface unevenness of a desired degree without revealing surface defects, etc.

A fifth object of the present invention is to provide a photoconductive member for electrophotography which can give an image of high quality with little image defect.

A sixth object of the present invention is to provide a surface treated metal member comprising a metal member having unevenness formed by a plurality of spherical mark impressions on the surface.

A seventh object of the present invention is to provide a method for preparing a surface treated metal member by permiting a plurality of true spheres of rigid body to free-fall on the surface of a metal member thereby to form unevenness with mark impressions of the aforesaid true spheres of rigid body on the surface of the aforesaid metal member.

An eighth object of the present invention is to provide a photoconductive member having a photoconductive layer on a substrate, wherein the substrate comprises a metal member having unevenness with a plurality of spherical mark impressions formed on the surface.

A ninth object of the present invention is to provide a surface treated metal member for a photoconductive member comprising an aluminum alloy of which surface defects after precision working are reduced and which is suitable particularly for a construction member for a photoconductive member for which accurate surface shape by precision working is desired.

A tenth object of the present invention is to provide a surface treated metal member for a photoconductive member comprising an aluminum alloy which is particularly suitable for a substrate of an electrophotographic photosensitive drum for which accurate surface shape and high dimensional precision by precision working are desired.

An eleventh object of the present invention is to provide a photoconductive member of which surface defects of the substrate are reduced and which is excellent in uniformity of electrical, optical and photoconductive characteristics.

DESCRIPTION OF THE PREFERRED EMBODIMENTS

Figure 1:
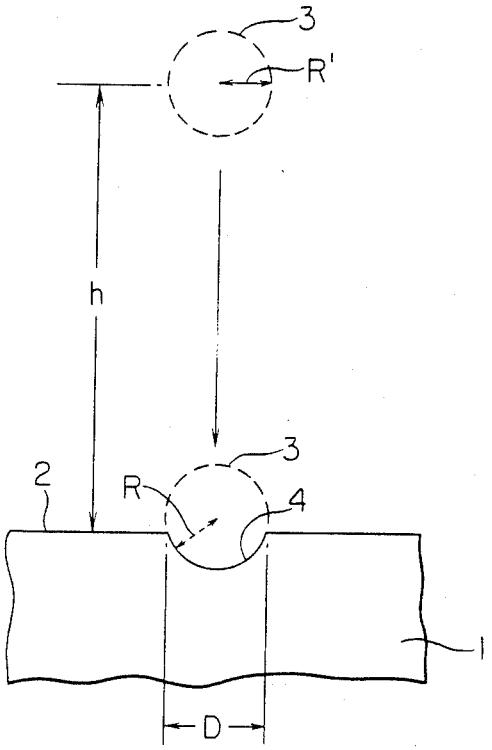
FIGS. 1 to 4 are schematic illustrations for explanation of the shape of unevenness on the surface of the metal member according to the present invention.

As shown in FIG. 1, the surface treated metal member 1 of the present invention comprises unevenness with a plurality of spherical mark impressions 4 formed on the surface 2.

That is, for example, rigid body true spheres 3 are permitted to free-fall from the position at a certain height from the surface 2 to collide against the surface 2 to form spherical mark impressions 4. Accordingly, by permitting a plurality of rigid body true spheres 3 with substantially the same diameter R' from substantially the same height h, a plurality of spherical mark impressions 4 with substantially the same radius of curvature R and the same width D can be formed on the surface 2.

Figure 2:
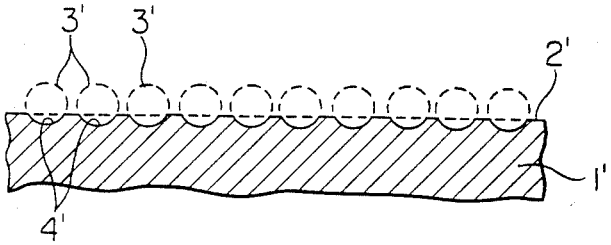
Figure 3:
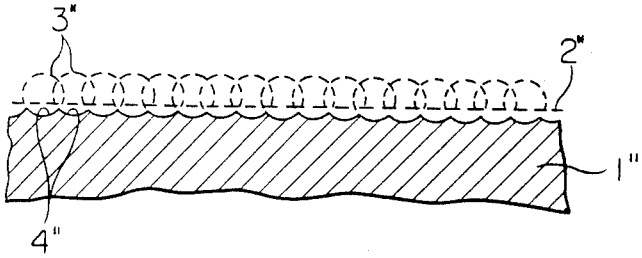

FIG. 2 and FIG. 3 show examples of the mark impressions formed in such cases. According to the example shown in FIG. 2, unevenness is formed by permitting a plurality of spherical bodies 3', 3' . . . with substantially the same diameter to fall from substantially the same height onto the surface 2' at different positions on the metal member 1', thereby forming a plurality of impressions 4', 4' . . . with substantially the same radius of curvature and width sparsely so that they may not overlap with each other.

According to the example shown in FIG. 3, the height of unevenness (surface coarseness) is made smaller than the example shown in FIG. 1 by forming a plurality of impressions 4'', 4'' . . . with substantially the same radius of curvature and width densely so that they may overlap with each other by permitting a plurality of spherical bodies with substantially the same diameter 3'', 3'' . . . to fall onto the positions on the surface 2'' of the metal member 1''. In this case, it is necessary as a matter of course to permit the spherical bodies to free-fall so that the timings for formation of the overlapping impressions 4'', 4'' . . . , namely the timings of collision of the spherical bodies 3'', 3'' . . . against the surface 2'' of the metal member 1'' should differ from each other.

Figure 4:
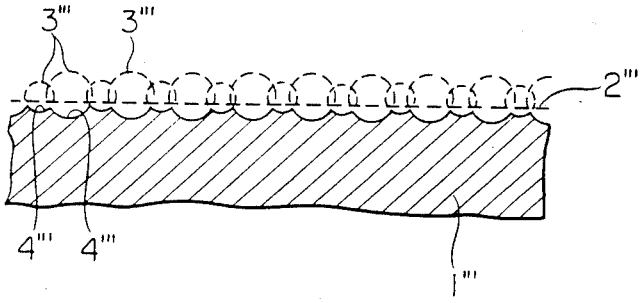

On the other hand, according to the example shown in FIG. 4, unevenness with irregular height is formed on the surface by permitting spherical bodies 3''', 3''' . .

. with several kinds of diameters different from each other to fall from substantially the same height or different heights to form a plurality of impressions 4''', 4''' . . . with different radius of curvature and widths different from each other so that they may overlap with each other.

By doing so, a plurality of spherical mark impressions with desired radius of curvature and width can be formed at a desired density on the surface of a metal member by controlling suitably the conditions such as hardnesses of the rigid body true sphere and the surface of the metal member, the radius of the rigid body true sphere, the falling height, the number of falling spheres, etc. Accordingly, it is possible to control freely the surface coarseness, namely the height or the pitch of unevenness such as finishing of the metal member surface to a mirror surface or a non-mirror surface by selection of the above conditions, and it is also possible to form unevenness of a desired shape depending on the purpose of use.

Further, the bad surface condition of a port hole tube or a mandrel extrusion drawn Al tube can be corrected by use of the method of the present invention to be finished to a desired surface condition. This is due to plastic deformation of the irregular unevenness of the surface by collision of rigid body true spheres.

The base material for the surface treated metal member of the present invention may be any kind of metals depending on the purpose of use, but it is practically aluminum and aluminum alloys, stainless steels, steel irons, copper and copper alloys, and magnesium alloys. Also, the shape of the metal member may be selected as desired. For example, as the substrate (support) for electrophotographic photosensitive member, shapes such as plates, cylinders, columns, endless belts, etc., may be practically used.

For the spherical bodies to be used in the present invention, there by be used, for example, various rigid body spheres made of metals such as stainless steel, aluminum, steel irons, nickel, brass, etc., ceramics, plastics, etc. Among them, rigid body spheres made of stainless steel or steel irons are preferred for the reasons of durability and low cost. The hardness of the spherical bodies may be either higher or lower than the hardness of the metal member, but it is preferably higher than the hardness of the metal member when the spherical bodies are used repeatedly.

The surface treated metal member of the present invention is suitable for supports of photoconductive members such as electrophotographic photosensitive members, magnetic disc substrates for computer memories or a polygon mirror substrates for laser scanning. Also, it is most suitable as the construction member for various electrical or electronic devices finished to a flatness degree with a surface coarseness of $R_{max}=1$ μm or less, preferably $R_{max}=0.05$ μm or less by use of a means such as mirror finishing with a diamond bit, cylindrical grind finishing, lapping finishing, etc.

Figure 5:
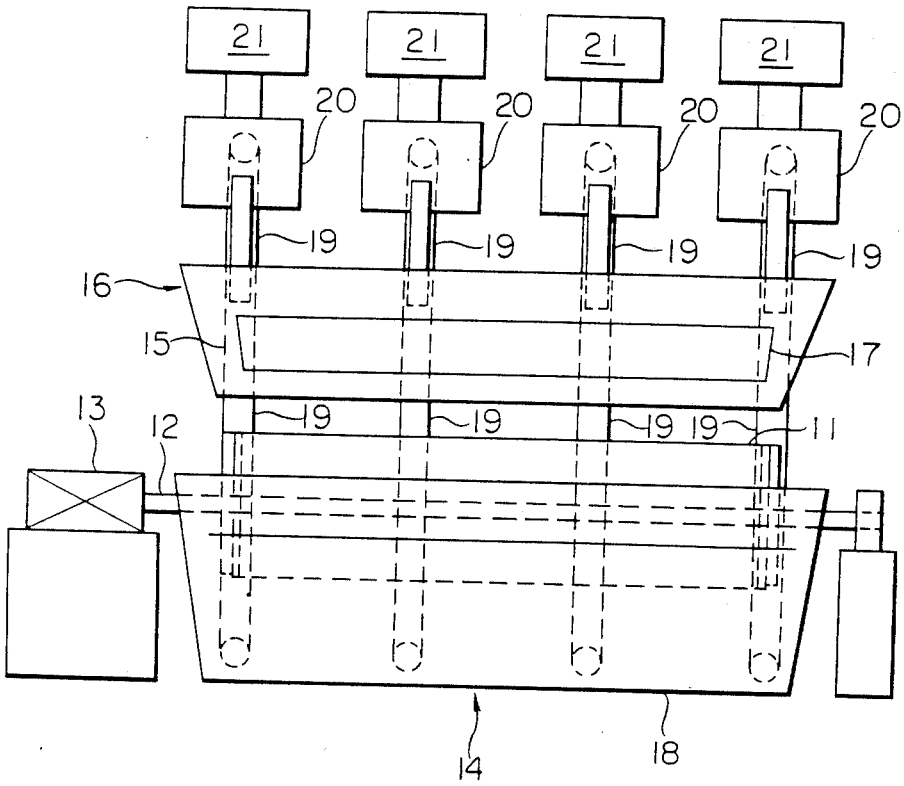
FIG. 5 and FIG. 6 are front view and longitudinal sectional view, respectively, for explanation of a constitutional example of the device for practicing the method for preparing the surface treated metal member according to the present invention.
Figure 6:
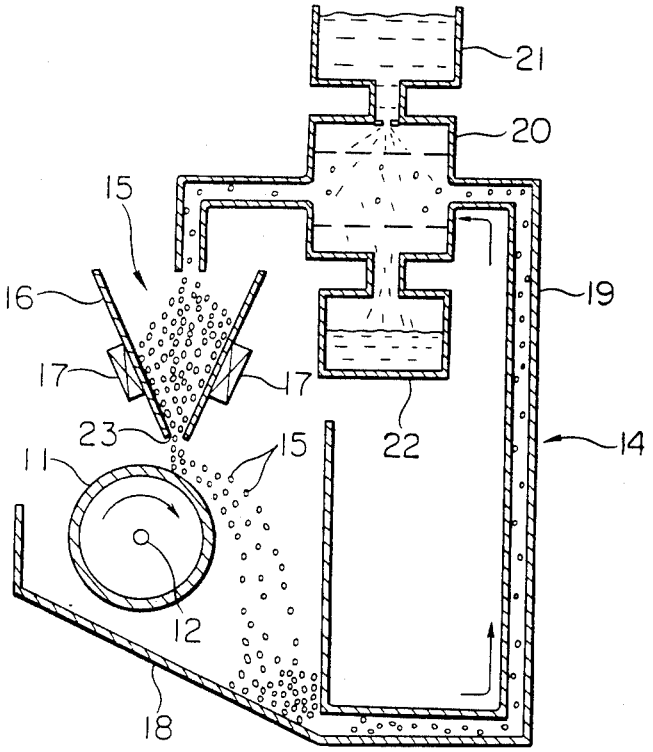

For example, when using as a support for an electrophotographic photosensitive drum, a drawn tube obtained by further subjecting a port hole tube or a mandrel tube obtained by conventional extrusion working of an aluminum alloy, etc. drawing working is applied optionally with treatment such as heat treatment or tempering, and the cylinder is worked by practicing the method of the present invention by using, for example, a device with the constitution as shown in FIG. 5 (front view) and FIG. 6 (longitudinal sectional view) to prepare a support.

In FIG. 5 and FIG. 6, 11 is, for example, an aluminum cylinder for preparation of a support. The surface of the cylinder 11 may be previously finished to a suitable flatness. The cylinder 11 is supported axially on a rotatory shaft 12, driven by a suitable driving means 13 such as a motor and is made rotatable substantially around the shaft core. The rotation speed is determined and controlled in view of the density of the spherical mark impressions formed and the amount of the rigid body true spheres supplied, etc.

14 is a device for permitting the rigid body true spheres (balls) 15 to free-fall, and it is constituted of a ball feeder 16 for storing and permitting the rigid body true spheres 15 to fall, a vibrator 17 for rocking the rigid body true spheres 15 so that they can fall readily from the feeder 16, a recovery tank 18 for recovering the rigid body true spheres 15 after collision against the cylinder 11, a ball delivering device 19 for transporting the rigid body true spheres recovered in the recovery tank 18 through a pipe to the feeder 16, a washing device 20 for liquid washing the rigid body true spheres 15 in the course of the delivering device 19, a reservoir 21 for supplying a washing liquid (solvent, etc.) through a nozzle, etc., to the washing device 20, and a recovery tank 22 for recovering the liquid used for washing.

The amount of the rigid body true spheres free-falling from the feeder 16 may be controlled suitably by the degree of opening of the dropping port 23, the extent of rocking by means of the vibrator 17, etc.

In the following, a constitutional example of the photoconductive member of the present invention is to be explained.

Such a photoconductive member is constructed by providing a photosensitive layer containing, for example, an organic photoconductive material or an inorganic photoconductive material on a support.

The shape of the support may be determined as desired, but, for example, when it is to be used for electrophotography it should be shaped in an endless belt or a cylinder as described above in the case of continuous high speed copying. The thickness of the support may be determined suitably so that a photoconductive member as desired may be formed, but when flexibility as the photoconductive member is demanded, it is made as thin as possible within the range so far as the function of a support can be fully exhibited. However, even in such a case, for preparation and handling of the support and further with respect to its mechanical strength, etc., it is generally made 10 μm or more.

The support surface is applied with the surface treatment according to the present invention, and made a mirror surface or a nonmirror surface for the purpose of prevention of interference fringe, or alternatively applied with unevenness with a desired shape.

For example, when the support surface is made a non-mirror surface or coarsened by imparting unevenness to the surface, unevenness is also formed on the photosensitive layer surface corresponding to the unevenness of the support surface, whereby phase difference will occur between the reflected light from the support surface and from the photosensitive layer surface to form an interference fringe due to shearing interference or form an image defect due to formation of black speckles or streaks during reversal development. Such a phenomenon will appear particularly when marked exposure is effected by a laser beam which is coherent light In the present invention, such an interference fringe can be prevented by controlling the radius of curvature R and width D of the spherical mark impressions formed on the surface of the support. That is, when using the surface treated metal member of the present invention as the support, by making D/R 0.035 or higher, 0.5 or more of Newton rings due to shearing interference exist in each of the mark impressions, while by making D/R 0.055 or higher, 1 or more of such Newton rings exist, whereby interference fringes of the photoconductive member as the whole can be permitted to exist as dispersed in each mark impressions and thus interference can be prevented.

Also, the width D of the mark impressions should desirably, 500 μm or less, more preferably 200 μm or less, further preferably 100 μm or less. It is also desired to be not greater than the spot diameter of photoradiation, particularly not greater than the resolution particularly when employing laser beam.

For example, when a photosensitive layer comprising an organic photoconductive member is to be provided on a support, the photosensitive layer can be separated into a charge generation layer and a charge transport layer. Also, between these photosensitive layers and the support, for prevention of carrier injection from the photosensitive layer to the support, or for improvement of adhesion between the photosensitive layer and the support, an intermediate layer comprising, for example, an organic resin can be provided. The charge generation layer can be formed by dispersing at least one charge generation substance selected from the known compounds such as azo pigments, quinone pigments, quinocyanine pigments, perylene pigments, indigo pigments, bisbenzimidazole pigments, quinacridone pigments, azulene compounds disclosed in Japanese Laid-open Patent Application No. 165263/1982, metal-free phthalocyanine pigments, phthalocyanine pigments containing metal ions, etc., in a binder resin such as polyester, polystyrene, polyvinyl butyral, polyvinyl pyrrolidone, methyl cellulose, polyacrylic acid esters, cellulose esters, etc., with the use of an organic solvent, followed by coating. The composition may be, for example, 20 to 300 parts by weight of a binder resin per 100 parts by weight of the charge generation substance. The charge generation layer should have a layer thickness desirably within the range of from 0.01 to 1.0 μm.

On the other hand, the charge transport layer can be formed by dispersing a positive-hole transporting substance selected from the compounds having in the main chain or the side chain a polycyclic aromatic compound such as anthracene, pyrene, phenanthrene, a coronene, etc., or a nitrogen-containing cyclic compound such as indole, oxazole, isooxazole, thiazole, imidazole, pyrazole, oxadiazole, pyrazoline, thiadiazole, triazole or the like, or hydrazone compounds, etc., in a binder resin such as polycarbonate, polymethacrylic acid esters, polyallylate, polystyrene, polyester, polysulfone, styrene-acrylonitrile copolymer, styrene-methyl methacrylate copolymer, etc., with the use of an organic solvent, followed by coating. The thickness of the charge transport layer is made 5 to 20 μm.

The above charge generation layer and the charge transport layer can be laminated in any desired order, for example, in the order of the charge generation layer, and the charge transport layer from the support side or in the order contrary thereto.

The photosensitive layer as mentioned above is not limited to those as described above but it is also possible to use a photosensitive layer employing a carge transfer complex comprising polyvinyl carbazole and trinitrofluorenone as disclosed in IBM Journal of the Research and Development, January, 1971, pp. 75–89 or pyrilium type compound as disclosed in U.S. Pat. Nos. 4,195,183 and 4,327,169; a photosensitive layer containing an inorqanic photoconductive material well known in the art such as zinc oxide or a cadmium sulfide dispersed in a resin; a vapour deposited film such as of selenium or selenium-tellurium; or a film comprising an amorphus material containing silicon atoms (a-Si(H,X)).

Among them, the photoconductive member employing a film comprising a-Si(H,X) as the photosensitive layer has a construction having, for example, a charge injection preventing layer, a photosensitive layer (photoconductive layer) and a surface protective layer laminated successively on the support according to the present invention as described above.

The charge injection preventing layer may be constructed of, for example, a-Si(H,X) and also contain atoms of the elements belonging to the group III or group V which is generally used as an impurities in semiconductors as the material for controlling conductivity. The layer thickness of the charge injection preventing layer should desirably be 0.01 to 10 μm, more preferably 0.05 to 8 μm, most preferably 0.07 to 5 μm.

In place of the charge injection preventing layer, a barrier layer comprising an electrically insulating material such as $Al_2O_3$, $SiO_2$, $Si_3N_4$, polycarbonate, etc., may be provided, or both the charge injection preventing layer and the barrier layer may be used in combination.

The photosensitive layer may be constituted of, for example, a-Si(H,X) and contain a substance for controlling conductivity different in kind from that used in the charge injection preventing layer, if desired. The layer thickness of the photosensitive layer may be preferably 1 to 100 μm, more preferably 1 to 80 μm, most preferably 2 to 50 μm.

The surface protective layer may be constituted of, for example, $SiC_X$, $SiN_X$, etc., and its layer thickness is preferably 0.01 to 10 μm, more preferably 0.02 to 5 μm, most preferably 0.04 to 5 μm.

In the present invention, for forming the photoconductive layer, etc., constituted of a-Si(H,X), there may be applied various vacuum deposition methods utilizing discharging phenomenon known in the art such as the glow discharge method, the sputtering method or the ion plating method.

In the present invention, when a charge injection preventing layer or a photosensitive layer comprising a-Si(H,X) is formed directly on the support, the material for the support should preferably be selected from among the aluminum alloys as shown below and subjected to the surface unevenness working as described above.

That is, the surface treated metal member as the support employs an aluminum alloy comprising crystal grains of aluminum as the matrix sectioned by boundary grains with their sizes (grain size as represented by the maximum length) being 300 μm at the maximum as its material, and has unevenness with a plurality of spherical mark impressions on its surface.

That is, if the size of crystal grain exceeds 300 μm, the stress during cutting working is poorly dispersed and a great stress is applied on one crystal grain, whereby the influence of the crystal orientation of one crystal grain is directly received to make the intergranular stepped difference undesirably greater. Also, the average value (for example, represented by the value calculated by dividing the length of the segment of line of the crystal grain existing within the segment of lines sectioned with a certain length) of the size of crystal grain (grain size represented by the maximum length) should be preferably 100 μm or less, more preferably 50 μm or less, and it is preferably as small as possible.

As the specific method for inhibiting the size of the crystal grains within the range as defined above, in the case of, for example, a tube obtained by extrusion and subsequent drawing working, there may be employed adequate controlling of working degree by making the contraction ratio and the drawing ratio during drawing working greater, adjustment of working degree during roll correction in the post-step thereof, and setting of the conditions with comformed working degree in the heat treatment in the final step.

Thus, the size of the crystal grains contained in the aluminum alloy has been defined in the present invention, but with respect to other alloy components including the matrix aluminum, there is no particular limitation and any desired kind and composition of the components can be selected. Accordingly, the aluminum alloys of the present invention include those standardized or resistered as JIS, AA STANDARD, BS STANDARD, DIN STANDARD, or International Alloy Registration for expanding materials, cast moldings, diecast, etc., such as alloys with compositions of pure aluminum type, AlCu type, Al-Mn type, Al-Si type, Al-Mg type, Al-Mg-Si type, Al-Zn-Mg type, etc.; Al-Cu-Mg type (duralumin, ultra-duralumin, etc.), Al-Cu-Si type (Lautal) Al-Cu-Ni-Mg type (Y alloy, RR alloy, etc.), sintered aluminum alloy (SAP), etc.

In the present invention, the composition of the aluminum alloy may be selected suitably with considerations about the characteristics corresponding to the purpose of use such as mechanical strength, corrosion resistance, workability, heat resistance, dimensional precision, etc.

Also, in aluminum alloys for general purpose, there generally exists precipitates or intervening matters caused by the alloy component positively added if desired or impurities entrained inevitably in the process of refining, ingotting, etc., and such matters may grow abnormally at grain boundaries, etc., form hard portions called a hard spot within the alloy structure, impair workability during precise working or become causes for deteriorating the characteristics of electronic parts obtained by precise working thereof. As described above, for example, silicon can form a solid solution with aluminum with difficulty and intervene as Si, $SiO_2$, Al-Si compounds, Al-Fe-Si compounds or Al-Si-Mg compounds with Al as $Al_2O_3$ in the aluminum structure in the form of, for example, islands. Also, Fe, Ti, etc., will appear as oxides in the form of hard grain boundary precipitates or hard spots.

Particularly, Si can form a solid solution with Al with difficulty even if contained at a low level of less than 0.5 weight % and is hard (particularly, $SiO_2$) and therefore, although contributing greatly to improvement of physical characteristics of Al alloys, it may be caught with a working tool during surface treatment finishing, whereby surface defects may be formed. Accordingly, in the aluminum alloy of the present invention, the size of various intervening matters as mentioned above (grain size represented by the maximum length of the intervening matter grains) should desirably be made 10 μm or less, more preferably 5 μm or less. More preferably, it is desirable to use an aluminum alloy in which the size of the above intervening matter is 10 μm or less and the content of silicon is less than 0.5 weight %, or an aluminum alloy in which the size of the above intervening matter is 10 μm or less, the content cf silicon is 0.5 to 7 weight %, and having a Vickers hardness of 50 Hv to 100 Hv.

As the specific method for inhibiting the size of the intervening matters in the aluminum alloy to 10 μm or less, for example, there may be employed the method in which a ceramic filter with small opening sizes is used during melting of the aluminum alloy and the filter effect is fully exibited under careful management, utilizing specifically the lot after the filter has been clogged to some extent. Further, there may be also employed a counter measure against entrainment of the melt furnace material or increase in facing thickness of the slug.

Further, for example, when mirror-finishing cutting working, etc., is accompanied during precise working, the cutting characteristics of the aluminum alloy can be improved by permitting magnesium and copper to coexist in the aluminum alloy. The content of magnesium or copper may be preferably each within the range from 0.5 to 10 weight %, particularly from 1 to 7 weight %. If the magnesium content is too high, intercrystalline corrosion is liable to occur, and therefore it is not desirable to add magnesium in excess of 10 weight %.

Also, iron contained in the aluminum alloy will form intermetallic compounds with coexisting aluminum or silicon of the Fe-Al type or the Fe-Al-Si type, which will appear as hard spots in the aluminum matrix. Particularly, the hard spots will be increased abruptly when iron content is increased higher than the critical level of 2000 ppm, and may have bad influences during, for example, mirror-finishing cutting working. Accordingly, the preferable content of iron in the aluminum alloy of the present invention is 2000 ppm or less, more preferably 1000 ppm or less.

Further, hydrogen contained in the aluminum alloy may give rise to structure abnormality such as blister, may impair workability during precise working or may cause deterioration of the characteristics of the electronic parts obtained by precise working thereof. Such inconveniences can be cancelled by inhibiting the hydrogen content in the aluminum alloy to 1.0 cc or lower, more preferably 0.7 cc or lower, per 100 g of aluminum.

As the specific method for inhibiting the content of iron contained in the aluminum alloy to 2000 ppm or less, there may be employed an aluminum bullion with high purity as a starting material, for example, one which has been subjected to repeated electrolytic refining. There may be also employed the method in which careful management is performed in the respective steps of melting and casting.

As the specific method for inhibiting the hydrogen content in the aluminum alloy to 1.0 cc or less per 100 g of aluminum, there may be employed the method in which chlorine gas is blown into the melt as the degassing step during melting of Al alloy thereby to remove $H_2$ existing in the alloy structure as HCl, or the method in which the melt Al alloy is maintained in a vaccum furnace for a certain period of time thereby to remove $H_2$ gas existing in the alloy structure through diffusion into vacuum.

In the following, typical examples of more preferable aluminum alloy compositions of the present invention are shown.

| | |
|---|---|
| | [Al—Mg type] |
| [Alloy A] | |
| Mg | 0.5 to 10 weight % |
| Si | 0.5 weight % or less |
| Fe | 0.25 weight % or less (preferably 2000 ppm or less) |
| Cu | 0.04 to 0.2 weight % |
| Mn | 0.01 to 1.0 weight % |
| Cr | 0.05 to 0.5 weight % |
| Zn | 0.03 to 0.25 weight % |
| Ti | Tr or 0.05 to 0.20 weight % |
| $H_2$ | 1.0 cc or less based on 100 g of Al |
| Al | substantially the balance |
| [Alloy B] | |
| Mg | 0.5 to 10 weight % |
| Si | 0.5 weight % or less |
| Fe | 2000 ppm or less |
| Cu | 0.04 to 0.2 weight % |
| Mn | 0.01 to 1.0 weight % |
| Cr | 0.05 to 0.5 weight % |
| Zn | 0.03 to 0.25 weight % |
| Ti | Tr or 0.05 to 0.20 weight % |
| $H_2$ | 1.0 cc or less based on 100 g of Al |
| Al | substantially the balance |
| | [Al—Mn type] |
| [Alloy C] | |
| Mn | 0.3 to 1.5 weight % |
| Si | 0.5 weight % or less |
| Fe | 0.25 weight % or less (preferably 2000 ppm or less) |
| Cu | 0.05 to 0.3 weight % |
| Mg | 0 or 0.2 to 1.3 weight % |
| Cr | 0 or 0.1 to 0.2 weight % |
| Zn | 0.1 to 0.4 weight % |
| Ti | Tr or about 0.1 weight % |
| $H_2$ | 1.0 cc or less based on 100 g of Al |
| Al | substantially the balance |
| [Alloy D] | |
| Mn | 0.3 to 1.5 weight % |
| Si | 0.5 weight % or less |
| Fe | 2000 ppm or less |
| Cu | 0.05 to 0.3 weight % |
| Mg | 0.2 to 1.3 weight % |
| Cr | 0 or 0.1 to 0.2 weight % |
| Zn | 0.1 to 0.4 weight % |
| Ti | Tr or about 0.1 weight % |
| $H_2$ | 1.0 cc or less based on 100 g of Al |
| Al | substantially the balance |
| | [Al—Cu type] |
| [Alloy E] | |
| Cu | 1.5 to 6.0 weight % |
| Si | 0.5 weight % or less |
| Fe | 0.25 weight % or less (preferably 2000 ppm or less) |
| Mn | 0 or 0.2 to 1.2 weight % |
| Mg | 0 or 0.2 to 1.8 weight % |
| Cr | 0 or about 0.1 weight % |
| Zn | 0.2 to 0.3 weight % |
| Ti | Tr or about 0.15 to 0.2 weight % |
| $H_2$ | 1.0 cc or less based on 100 g of Al |
| Al | substantially the balance |
| [Alloy F] | |
| Cu | 1.5 to 6.0 weight % |
| Si | 0.5 weight % or less |
| Fe | 2000 ppm or less |
| Mn | 0 or 0.2 to 1.2 weight % |
| Mg | 0 or 0.2 to 1.8 weight % |
| Cr | 0 or about 0.1 weight % |
| Zn | 0.2 to 0.3 weight % |
| Ti | Tr or 0.15 to 0.2 weight % |
| $H_2$ | 1.0 cc or less based on 100 g Al |
| Al | substantially the balance |
| | [Pure aluminum type] |
| [Alloy G] | |
| Mg | 0.02 to 0.5 weight % |
| Si | 0.3 weight % or less |

-continued

| | |
|---|---|
| Fe | 2000 ppm or less |
| Cu | 0.03 to 0.1 weight % |
| Mn | 0.02 to 0.05 weight % |
| Cr | Tr |
| Zn | 0.03 to 0.1 weight % |
| Ti | Tr or 0.03 to 0.1 weight % |
| $H_2$ | 1.0 cc or less based on 100 g of Al |
| Al | substantially the balance |
| [Alloy H] | |
| Mg | 0.02 to 0.5 weight % |
| Si | 0.3 weight % or less |
| Fe | 0.25 weight % or less (preferably 2000 ppm or less) |
| Cu | 0.03 to 0.1 weight % |
| Mn | 0.02 to 0.05 weight % |
| Cr | Tr |
| Zn | 0.03 to 0.1 weight % |
| Ti | Tr or 0.03 to 0.1 weight % |
| $H_2$ | 1.0 cc or less based on 100 g of Al |
| Al | substantially the balance |
| | [Al—Mg—Si type] |
| [Alloy I] | |
| Mg | 0.35 to 1.5 weight % |
| Si | 0.5 to 7 weight % |
| Fe | 0.25 weight % or less (preferably 2000 ppm or less) |
| Cu | 0.1 to 0.4 weight % |
| Mn | 0.03 to 0.8 weight % |
| Cr | 0.03 to 0.35 weight % |
| Zn | 0.1 to 0.25 weight % |
| Ti | Tr or about 0.10 to 0.15 weight % |
| $H_2$ | 1.0 cc or less based on 100 g of Al |
| Al | substantially the balance |
| [Alloy J] | |
| Mg | 0.35 to 1.5 weight % |
| Si | 0.5 to 7 weight % |
| Fe | 2000 ppm or less |
| Cu | 0.1 to 0.4 weight % |
| Mn | 0.03 to 0.8 weight % |
| Cr | 0.03 to 0.35 weight % |
| Zn | 0.1 to 0.25 weight % |
| Ti | Tr or 0.1 to 0.15 weight % |
| $H_2$ | 1.0 cc or less based on 100 g of Al |
| Al | substantially the balance |

(The above Tr means the trace amount when the component is not positively added).

The aluminum alloy according to the present invention is subjected to plastic working such as rolling, extrusion, etc., then applied with precise working accompanied with the chemical or physical method such as the mechanical method of cutting or grinding or chemical etching, etc., optionalily combined with heat treatment, tempering, etc., as desired, to be formed into a shape suitable for the purpose of use. For example, in the case of forming a tubular structural member such as a photosensitive drum for electrophotography for which strict dimensional precision is demanded, it is preferable to use a drawn tube obtained by subjecting a port hole extruded tube or a mandrel extruded tube obtained by conventional extrusion working further to cold draw working.

Next, an example of the method for preparation of a photoconductive member according to the glow discharge decomposition method is to be explained.

Figure 7:
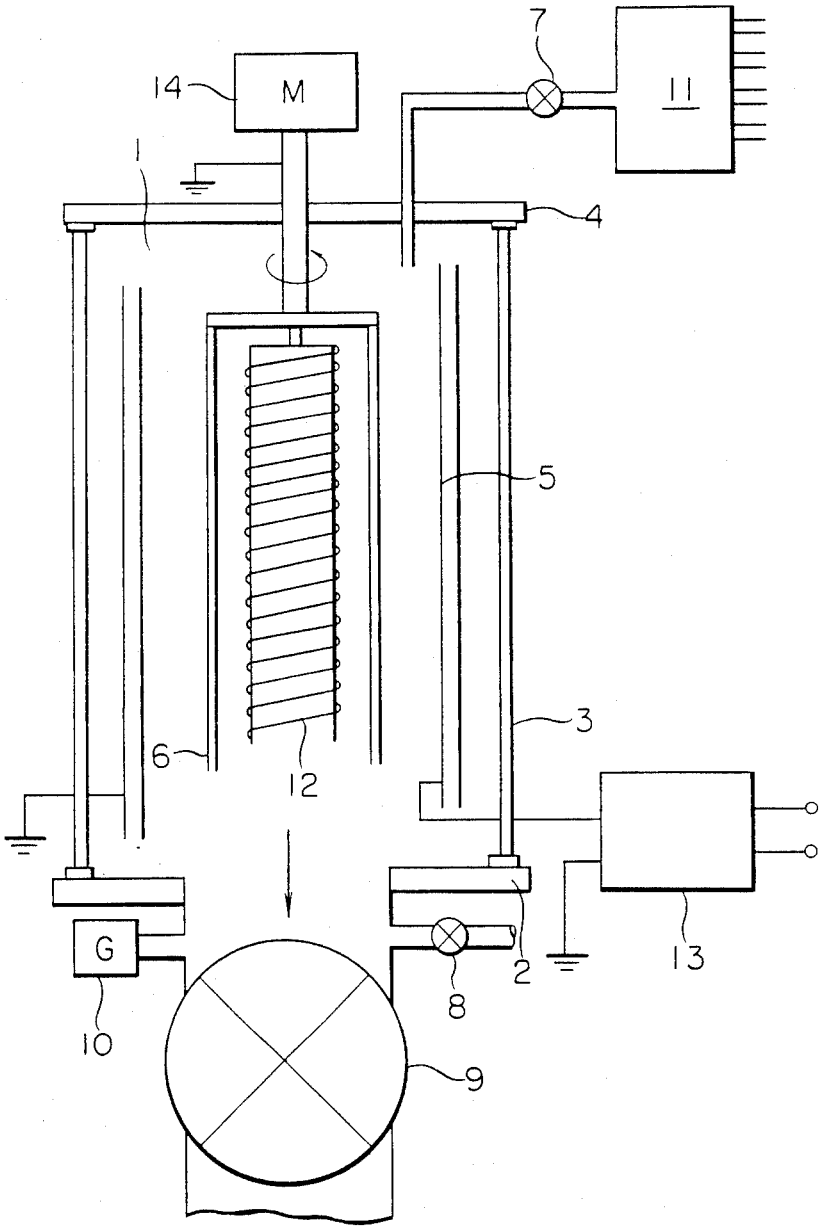
FIG. 7 is a schematic illustration showing the device for preparing the photoconductive member according to the glow discharge decomposition method.

FIG. 7 shows a device for preparation of a photoconductive member according to the glow discharge decomposition method. The deposition chamber 1 consists of a base plate 2, a chamber wall 3 and a top plate 4 and within this deposition chamber 1 a cathode electrode 5 is provided. The support 6 according to the present invention made of, for example, an aluminum alloy on which a-Si(H,X) deposited film is formed is placed at the central portion of the cathode electrode 5 and also functions as the anode electrode.

For formation of a-Si(H,X) deposited film by use of this preparation device, first the inflow valve 7 for the starting gas and the leak valve 8 are closed and the discharging valve 9 is opened to evacuate the deposition chamber 1. When the reading on the vaccum gauge 10 becomes $5\times10^{-6}$ torr, the starting gas inflow valve 7 is opened and the opening of the discharging valve 9 is controlled while watching the reading on the vaccum gauge 10 so that the pressure of the starting gas mixture by use of, for example, $SiH_4$ gas, Si gas, $SiF_4$ gas adjusted to a desired mixing ratio in the mass flow controller 11, within the deposition chamber 1 may become a desired value. And, after confirming that the surface temperature of the drum-shaped support 6 is set at a predetermined temperature by a heater 12, the high frequency power source 13 is set at a desired power and glow discharge is excited within the deposition chamber 1.

Also, during layer formation, the drum-shaped support 6 is rotated at a constant speed by a motor 14 in order to uniformize layer formation. Thus, an a-Si deposited film can be formed on the drum-shaped support 6.

The present invention is described in more detail by referring to Test examples and Examples.

TEST EXAMPLE 1

By use of a rigid body true sphere made of a SUS stainless steel with a diameter of 2 mm and a device as shown in FIG. 5 and FIG. 6, the surface of a cylinder made of an aluminum alloy (diameter 60 mm, length 298 mm) was treated to form unevenness.

The relationship between the diameter R′ of the true sphere, the falling height h and the radius of curvature R and the width D of the mark impressions was examined. As a result, it was confirmed that the radius of curvature R and the width D of the mark impressions could be determined by the conditions of the diameter R′ of the true sphere, the falling height h and the like. It was also confirmed that the pitch of the mark impressions (density of mark impressions, also pitch of unevenness) could be controlled to a desired pitch by controlling the rotation speed, rotation number of the cylinder or the number of the falling rigid body true spheres.

EXAMPLES 1-6, COMPARATIVE EXAMPLE 1

Except for controlling D/R values to those indicated in Table 1B, the surface of the cylinder made of aluminum alloy was treated in the same manner as Test example 1, and the treated product is utilized as the supporting member for the photoconductive member for electrophotography.

After the surface treatment for each surface treated cylinder, the surface defects formed (gouge-like scars, cracks, streaks, etc.) were examined with naked eyes and a metal microscope. The results are shown in the Table.

Next, on these respective cylinders of aluminum alloy applied with the surface treatment, photoconductive members were prepared under the conditions shown in Table 1A by means of the preparation device of photoconductive members shown in FIG. 7 following the glow discharge decomposition method as described in detail above.

TABLE 1A

| Lamination order of deposited films | | Starting gases employed | Film thickness (μm) |
|---|---|---|---|
| ① | Charge injection preventing layer | $SiH_4$/ $B_2H_6$ | 0.6 |
| ② | Photoconductive layer | $SiH_4$ | 20 |
| ③ | Surface protective layer | $SiH_4$/ $C_2H_4$ | 0.1 |

The respective photoconductive members thus obtained were placed in laser beam printer LBP-X produced by Canon Inc. to perform image formation, and overall evaluations with respect to interference fringe, black dots, image defects, etc., were conducted. The results are shown in Table 1B.

For comparison, a photoconductive member was prepared by use of a cylinder made of aluminum alloy subjected to surface treatment with a diamond bit of the prior art, and overall evaluations were similarly conducted.

TABLE 1B

| Example NO (D/R) | Number of defects generated in the surface treatment step | Result of overall evaluation of interference fringe, black dot and image defect (*) |
|---|---|---|
| Example 1 (0.02) | 0 | X |
| Example 2 (0.03) | 0 | Δ |
| Example 3 (0.036) | 0 | |
| Example 4 (0.05) | 0 | |
| Example 5 (0.056) | 0 | ◎ |
| Example 6 (0.07) | 0 | ◎ |
| Comparative Example 1 (—) | numberless | X |

(*):
X practically unusable
Δ practically unsuitable
○ practically good
◎ practically very good D in the supporting members for the photoconductive members of Example 1 to 6 was all made 500 μm.

EXAMPLES 7, 8

The same photoconductive members as Example 1-6 were prepared except for making the layer constitutions as described below.

In these Examples, two photoconductive members were prepared by changing D/R of the surface of the cylinder made of aluminum alloy to 0.05 (Example 7) and 0.07 (Example 8), respectively.

First, an intermediate layer with a layer thickness of 1 μm was formed by use of a coating solution having a copolymer nylon resin dissolved in a solvent.

Next, a coating solution containing ε-type copper phthalocyanine and a butyral resin as the binder resin was applied on the intermediate layer to form a charge generation layer with a layer thickness of 0.15 μm followed by coating with a coating solution containing a hydrazone compound and a styrene-methyl methacrylate copolymer resin as the binder resin on the charge generation layer to form a charge transport layer with a layer thickness of 16 μm. Thus, a photoconductive member was prepared. The photoconductive members thus obtained were evaluated according to the same overall evaluation as in Examples 1–6. As the results, both Example 7 and Example 8 were practical. Particularly, the photoconductive member of Example 8 was found to be excellent.

TEST EXAMPLE 2

By use of a rigid body true sphere made of a SUS stainless steel with a diameter of 2 mm and a device as shown in FIG. 5 and FIG. 6, the surface of a cylinder made of an Al-Mg type aluminum alloy (crystal grain size: maximum 200 μm; average 50 μm) (diameter 60 mm, length 298 mm) was treated to form unevenness.

The relationship between the diameter R′ of the true sphere, the falling height h and the radius of curvature R and the width D of the mark impressions was examined. As a result, it was confirmed tha+the radius of curvature R and the width D of the mark impressions could be determined by the conditions of the diameter R′ of the true sphere, the falling height h and the like. It was also confirmed that the pitch of the mark impressions (density of mark impressions, also pitch of unevenness) could be controlled to a desired pitch by controlling the rotation speed, rotation number of the cylinder or the number of falling rigid body true spheres.

EXAMPLES 9–14

Except for controlling D/R values to those indicated in Table 2B, the surface of the cylinder made of aluminum alloy was treated in the same manner as Test Example 2, and the treated product was utilized as the supporting member for the photoconductive member for electrophotography.

After the surface treatment for each surface treated cylinder, the surface defects formed (gouge-like scars, cracks, streaks, etc.) were examined with naked eyes and a metal microscope. The results are shown in the Table.

Next, on these respective cylinders of aluminum alloy applied with the surface treatment, photoconductive members were prepared under the conditions shown in Table 2A by means of the preparation device of photoconductive members shown in FIG. 7 following the glow discharge decomposition method as described in detail above.

TABLE 2A

| | Lamination order of deposited films | Starting gases employed | Film thickness (μm) |
|---|---|---|---|
| ① | Charge injection preventing layer | $SiH_4$/ $B_2H_6$ | 0.6 |
| ② | Photoconductive layer | $SiH_4$ | 20 |
| ③ | Surface protective layer | $SiH_4$/ $C_2H_4$ | 0.1 |

The respective photoconductive members thus obtained were placed in laser beam printer LBP-X produced by Canon INC. to perform image formation, and overall evaluations with respect to interference fringe, black dots, image defects, etc., were conducted. The results are shown in Table 2B.

TABLE 2B

| Example No (D/R) | Number of defects generated in the surface treatment step | Result of overall evaluation of interference fringe, black dot and image defect (*) |
|---|---|---|
| Example 9 (0.02) | 0 | X |
| Example 10 (0.03) | 0 | Δ |
| Example 11 (0.036) | 0 | ○ |
| Example 12 (0.05) | 0 | ○ |
| Example 13 (0.056) | 0 | ◎ |
| Example 14 (0.07) | 0 | ◎ |
| Comparative Example 1 (—) | numberless | X |

(*):
X practically unusable
Δ practically unsuitable
○ practically good
◎ practically very good D in the supporting members for the photoconductive members of Examples 9 to 14 was all made 500 μm.

EXAMPLES 15–17, COMPARATIVE EXAMPLES 2, 3

On the five kinds of cylinders made of Al-Mg type aluminum alloys with different crystal grains as shown in Table 3B (Mg content was all 4 weight %, Fe content was all 1000 ppm or less), the same surface treatment was applied in the same manner as in Examples 9–14, respectively.

Next, on these respective cylinders of aluminum alloy applied with the surface treatment, photoconductive members were prepared under the conditions shown in Table 3A by means of the preparation device of photoconductive members shown in FIG. 7 following the glow discharge decopposition method as described in detail above.

TABLE 3A

| | Lamination order of deposited films | Starting gases employed | Film thickness (μm) |
|---|---|---|---|
| ① | Charge injection preventing layer | $SiH_4$/ $B_2H_6$ | 0.6 |
| ② | Photoconductive layer | $SiH_4$ | 20 |
| ③ | Surface protective layer | $SiH_4$/ $C_2H_4$ | 0.1 |

Aluminum cylinder temperature: 250° C.
Inner pressure in deposition chamber during formation of deposited film: 0.3 Torr
Discharging frequency: 13.56 MHz
Film forming speed: 20 Å/sec
Discharging power: 0.18 W/cm$^2$ Each of the thus obtained electrophotographic photosensitive drums was placed in a 400 RE copying device produced by Canon Inc., and image formation was performed and evaluation of image defects in shape of white dots (0.3 Φ or more) was practiced. The evalaution results are shown in Table 3B.

For each of the respective electrophotographic photosensitive drums of Examples 15–17, successive copying tests of one million sheets was further practiced under the respective environments of 23° C./relative humidity 50%, 30° C./relative humidity 90%, 5° C./relative humidity 20%. As the result, it was confirmed to have good durability without increase of image defects, particularly defects such as white dropout etc.

TABLE 3B

| Example No | Size of crystal grain (average μm) | Image defect (number/A3) |
|---|---|---|
| Example 15 | Max. 150 (50) | 0 |
| Example 16 | Max. 300 (100) | 0 |
| Example 17 | Max. 900 (300) | 10 |
| Comparative Example 2 | Max. 1500 (500) | 40 |
| Comparative Example 3 | Max. 3000 (1000) | Numberless |

EXAMPLES 18, 19, COMPARATIVE EXAMPLES 4, 5

The same cylinder made of aluminum alloy and photoconductive member as in Example 15 were prepared except for using, in place of the Al-Mg type aluminum alloy, a pure aluminum type and an Al-Mg-Si type alumium alloy (Fe contents are all 1000 ppm or less, $H_2$ content was all 1.0 cc/100 g Al or less). The image defects when performing image formation for the cylinders thus obtained were evaluated similarly as in Example 9, and the results are shown in Table 4B.

TABLE 4

| Example No | Size of crystal grain (average μm) | Image defect (number/A3) |
|---|---|---|
| Example 18 (pure Al type) | Max. 300 (100) | 0 |
| Comparative Example 4 (pure Al type) | Max. 900 (300) | 30 |
| Example 19 (Al—Mg—Si type) | Max. 300 (100) | 0 |
| Comparative Example 5 (Al—Mg—Si type) | Max. 900 (300) | 35 |

TEST EXAMPLE 3

By use of a rigid body true sphere made of a SUS stainless steel with a diameter of 2 mm and a device as shown in FIG. 5 and FIG. 6, the surface of a cylinder made of an Al-Mg type aluminum alloy with the size of the impurity being 3 μm at its maximum (diameter 60 mm, length 298 mm; Si content less than 0.5 wt. %, Mg content 4 wt. %, Fe content 1000 ppm or less) was treated to form unevenness.

The relationship between the diameter R' of the true sphere, the falling height h and the radius of curvature R and the width D of the mark impressions was examined. As a result, it was confirmed that the radius of curvature R and the width D of the mark impressions could be determined by the conditions of the diameter R' of the true sphere, the falling height h and the like. It was also confirmed that the pitch of the mark impressions (density of mark impression, also pitch of unevenness) could be controlled to a desired pitch by controlling the rotation speed, rotation number of the cylinder or the number of falling rigid true body spheres.

EXAMPLES 20–25

Except for controlling D/R values to those indicated in Table 5B, the surface of the cylinder made of aluminum alloy of the same quality was treated in the same manner as in Test Example 3, and the treated product was utilized as the supporting member for the photoconductive member for electrophotography.

After the surface treatment for each surface treated cylinder, the surface defects formed (gougelike scars, cracks, streaks, etc.) were examined with naked eyes and a metal microscope. The results are shown in the Table.

Next, on these respective cylinders of aluminum alloy applied with the surface treatment, photoconductive members were prepared under the conditions shown in Table 5A by means of the preparation device for photoconductive members shown in FIG. 7 following the glow discharge decomposition method as described in detail above.

TABLE 5A

| Lamination order of deposited films | | Starting gases employed | Film thickness (μm) |
|---|---|---|---|
| ① | Charge injection preventing layer | $SiH_4$/ $B_2H_6$ | 0.6 |
| ② | Photoconductive layer | $SiH_4$ | 20 |
| ③ | Surface protective layer | $SiH_4$/ $C_2H_4$ | 0.1 |

The respective photoconductive members thus obtained were placed in laser beam printer LBP-X produced by Canon Inc. to perform image formation, and overall evaluations with respect to interference fringe, black dots, image defects, etc., were conducted. The results are shown in Table 5B.

TABLE 5B

| Example No (D/R) | Number of defects generated in the surface treatment step | Result of overall evaluation of interference fringe, black dot and image defect (*) |
|---|---|---|
| Example 20 (0.02) | 0 | X |
| Example 21 (0.03) | 0 | Δ |
| Example 22 (0.036) | 0 | ○ |
| Example 23 (0.05) | 0 | ○ |
| Example 24 (0.056) | 0 | ◎ |
| Example 25 (0.07) | 0 | ◎ |
| Comparative Example 1 (—) | Numberless | X |

(*):
X practically unusable
Δ practically unsuitable
○ practically good
◎ practically very good D in the supporting members for the photoconductive members of Examples 20 to 25 was all made 500 μm.

EXAMPLES 26–28, COMPARATIVE EXAMPLES 6, 7

On the five kinds of cylinders made of Al-Mg type aluminum alloys with different sizes of impurities as shown in Table 6B (Si content was all less than 0.5 wt. %, Mg content was all 4 weight %, Fe content was all 1000 ppm or less), the same surface treatment was applied in the same manner as in Examples 20–25, respectively.

Next, on these respective cylinders of aluminum alloy applied with the surface treatment, photoconductive members were prepared under the conditions shown in Table 6A by means of the preparation device of photoconductive members shown in FIG. 7 following the glow discharge decomposition method as described in detail above.

TABLE 6A

| Lamination order of deposited films | Starting gases employed | Film thickness (μm) |
|---|---|---|
| ① Charge injection preventing layer | $SiH_4$/ $B_2H_6$ | 0.6 |
| ② Photoconductive layer | $SiH_4$ | 20 |
| ③ Surface protective layer | $SiH_4$/ $C_2H_4$ | 0.1 |

Aluminum cylinder temperature: 250° C.
Inner pressure in deposition chamber during formation of deposited film: 0.3 Torr
Discharging frequency: 13.56 MHz
Film forming speed: 20 Å/sec
Discharging power: 0.18 W/cm$^2$ Each of the thus obtained electrophotographic photosensitive drums was placed in a 400 RE copying device produced by Canon Inc., and image formation was performed and evaluation of image defects in shape of white dots (0.3 mm Φ or more) was practiced. The evalaution results are shown in Table 6B.

For each of the respective electrophotographic photosensitive drums of Examples 26–28, successive copying tests of one million sheets were further practiced under the respective environments of 23° C./relative humidity 50%, 30° C./relative humidity 90%, 5° C./relative humidity 20%. As the result, it was confirmed to have good durability without increase of image defects, particularly defects such as white dropout, etc.

TABLE 6B

| Example No | Size of impurity | Hard spot number (*1) (number/mm$^2$) | Number of defects generated in mirror-finishing step (*2) (number/100 cm$^2$) | Image defect (number/A3) |
|---|---|---|---|---|
| Example 26 | Max. 1 μm | 5 | 0 | 0 |
| Example 27 | Max. 5 μm | 10 | 1 | 0 |
| Example 28 | Max. 10 μm | 30 | 2 | 0 |
| Comparative Example 6 | Max. 20 μm | 70 | 50 | 10 |
| Comparative Example 7 | Max. 30 μm | Numberless | Numberless | Numberless |

(*1): by observation with microscope
(*2): by examination with naked eyes (defect of 5 μm as observed by microscope is visible in the shape of streak)

EXAMPLES 29–31, COMPARATIVE EXAMPLES 8–10

The same cylinder made of aluminum alloy and photoconductive member as Example 20 were prepared except for using, in place of the Al-Mg type aluminum alloy, an Al-Mn type, Al-Cu type and a pure aluminum type aluminum alloy (Fe contents are all 1000 ppm or less).

The number of hard spots, the number of defects generated in the mirror finishing process and the image defects when performing image formation for the cylinders thus obtained were evaluated similarly as in Example 20, and the results are shown in Table 7.

TABLE 7

| Example No | Alloy type (Si content wt. %) | Size of impurity (μm) | Hard spot number (*1) (number/mm$^2$) | Number of defects generated in mirror-finishing step (*2) (number/100 cm$^2$) | Image defect (number/A3) |
|---|---|---|---|---|---|
| Example 29 | Al—Mn type (0.3) | Max. 10 | 20 | 2 | 0 |
| Comparative Example 8 | Al—Mn type (0.3) | Max. 30 | Numberless | Numberless | Numberless |
| Example 30 | Al—Cu type (0.3) | Max. 10 | 25 | 2 | 0 |
| Comparative Example 9 | Al—Cu type (0.3) | Max. 30 | Numberless | Numberless | Numberless |
| Example 31 | pure Al type (0.2) | Max. 10 | 30 | 1 | 0 |
| Comparative Example 10 | pure Al type (0.2) | Max. 30 | Numberless | Numberless | Numberless |

(*1): by observation with microscope
(*2): by examination with naked eyes (defect of 5 μm as observed by microscope is visible in the shape of streak)

EXAMPLES 32–35

The same cylinder made of the A(-Mg type aluminum alloy and photoconductive member as Example 20 were prepared except for changing the Fe content to the values shown in Table 8.

The number of hard spots, the number of defects generated in the mirror finishing process and the image defects when performing image formation for the cylinders thus obtained were evaluated similarly as in Example 20, and the results are shown in Table 8.

TABLE 8

| Example No | Fe content (ppm) | Size of impurity (μm) | Hard spot number (*1) (number/mm²) | Number of defects generated in mirror-finishing step (*2) (number/100 cm²) | Image defect (number/A3) |
|---|---|---|---|---|---|
| Example 32 | 1000 or less | Max. 10 | 20 | 10 | 0 |
| Example 33 | 1500 | Max. 10 | 50 | 20 | 5 |
| Example 34 | 2500 | Max. 10 | 100 | 30 | 10 |
| Example 35 | 5000 | Max. 10 | Numberless | Numberless | Numberless |

(*1): by observation with microscope
(*2): by examination with naked eyes (defect of 5 μm as observed by microscope is visible in the shape of streak)

TEST EXAMPLE 4

By use of a rigid body true sphere made of a SUS stainless steel with a diameter of 2 mm and a device as shown in FIG. 5 and FIG. 6, the surface of a cylinder made of an Al-Mg-Si type aluminum alloy containing 3 wt. % of Si, having a Vickers hardness of 70 Hv, with the size of the impurity being 2 μm at its maximum (diameter 60 mm, length 298 mm; Mg content 4 wt. %, Fe content 1000 ppm or less; hydrogen content 1.0 cc or less per 100 grams of aluminum) was treated to form unevenness.

The relationship between the diameter R′ of the true sphere, the falling height h and the radius of curvature R and the width D of the mark impressions was examined. As a result, it was confirmed that the radius of curvature R and the width D of the mark impressions could be determined by the conditions of the diameter R′ of the true sphere, the falling height h and the like. It was also confirmed that the pitch of the mark impressions (density of mark impressions, also pitch of unevenness) could be controlled to a desired pitch by controlling the rotation speed, rotation number of the cylinder or the number of falling rigid body true spheres.

EXAMPLES 36–41

Except for controlling D/R values to those indicated in Table 9B, the surface of the cylinder made of aluminum alloy of the same quality was treated in the same manner as in Test Example 4, and the treated product was utilized as the supporting member for the photoconductive member for electrophotography.

After the surface treatment for each surface treated cylinder, the surface defects formed (gougelike scars, cracks, streaks, etc.) were examined with naked eyes and a metal microscope. The results are shown in the Table.

Next, on these respective cylinders of aluminum alloy applied with the surface treatment, photoconductive members were prepared under the conditions shown in Table 9A by means of the preparation device for photoconductive members shown in FIG. 7 following the glow discharge decomposition method as described in detail above.

TABLE 9A

| Lamination order of deposited films | Starting gases employed | Film thickness (μm) |
|---|---|---|
| ① Charge injection preventing layer | $SiH_4$/$B_2H_6$ | 0.6 |
| ② Photoconductive layer | $SiH_4$ | 20 |
| ③ Surface protective layer | $SiH_4$/$C_2H_4$ | 0.1 |

The respective photoconductive members thus obtained were placed in laser beam printer LBP-X produced by Canon Inc. to perform image formation, and overall evaluations with respect to interference fringe, black dots, image defects, etc., were conducted. The results are shown in Table 9B.

TABLE 9B

| Example No (D/R) | Number of defects generated in the surface treatment step | Result of overall evaluation of interference fringe, black dot and image defect (*) |
|---|---|---|
| Example 36 (0.02) | 0 | X |
| Example 37 (0.03) | 0 | Δ |
| Example 38 (0.036) | 0 | |
| Example 39 (0.05) | 0 | |
| Example 40 (0.056) | 0 | |
| Example 41 (0.07) | 0 | |
| Comparative Example 1 (—) | Numberless | X |

(*):
X practically unusable
Δ practically unsuitable
practically good
practically very good D in the supporting members for the photoconductive members of Examples 36 to 41 was all made 500 μm.

EXAMPLES 42–45, COMPARATIVE EXAMPLES 11

On the five kinds of cylinders made of Al-Mg-Si type aluminum alloys with differences in Si content, Vickers hardness and size of impurities as shown in Table 10B (Mg content was all 4 weight %, Fe content was all 1000 ppm or less), the same surface treatment was applied in the same manner as in Examples 36–41, respectively.

Next, on these respective cylinders of.aluminum alloy applied with the surface treatment, photoconductive members were prepared under the conditions shown in Table 10A by means for the preparation device of photoconductive members shown in FIG. 7 following the glow discharge decomposition method as described in detail above.

TABLE 10A

| Lamination order of deposited films | Starting gases employed | Film thickness (μm) |
|---|---|---|
| ① Charge injection preventing layer | $SiH_4$/$B_2H_6$ | 0.6 |

TABLE 10A-continued

| Lamination order of deposited films | Starting gases employed | Film thickness (μm) |
|---|---|---|
| ② Photoconductive layer | $SiH_4$ | 20 |
| ③ Surface protective layer | $SiH_4$/ $C_2H_4$ | 0.1 |

Aluminum cylinder temperature: 250° C.
Inner pressure in deposition chamber during formation of deposited film: 0.3 Torr
Discharging frequency: 13.56 MHz
Film forming speed: 20 Å/sec
Discharging power: 0.18 W/cm$^2$ Each of the thus obtained electrophotographic photosensitive drums was placed in a 400 RE copying device produced by Canon Inc., and image formation was performed and evaluation of image defects in shape of white dots (0.3 mm Φ or more) was practiced. The evalaution results are shown in Table 10B.

For each of the respective electrophotographic photosensitive drums of Examples 42–45, successive copying tests of one million sheets were further practiced under the respective environments of 23° C./relative humidity 50%, 30° C./relative humidity 90%, 5° C./relative humidity 20%. As the result, it was confirmed to have good durability without increase of image defects particularly defects such as white dropout, etc.

TABLE 10B

| Example No | Vickers hardness (Hv) (Si content wt. %) | Size of impurity (μm) | Hard spot number (*1) (number/mm$^2$) | Number of defects generated in mirror-finishing step (*2) (number/100 cm$^2$) | Image defect (number/A3) |
|---|---|---|---|---|---|
| Example 42 | 65 (2) | Max. 1 | 5 | 0 | 0 |
| Example 43 | 65 (2) | Max. 5 | 10 | 2 | 0 |
| Example 44 | 85 (4) | Max. 10 | 35 | 3 | 0 |
| Example 45 | 85 (4) | Max. 20 | 100 | 65 | 25 |
| Comparative Example 11 | 130 (11) | Max. 30 | Numberless | Numberless | Numberless |

(*1): by observation with microscope
(*2): by examination with naked eyes (defect of 5 μm as observed by microscope is visible in the shape of streak)

According to the present invention, the surface treatment can be done without accompaniment of cutting working which will readily give rise to the surface defects impairing the desired use characteristics, and therefore a photoconductive member excellent in uniformity of film formation, and uniformity of electrical, optical or photoconductive characteristics can be obtained. Particularly, images of high quality with little image defect can be obtained when it is used for a electrophotographic photosensitive member.

What we claim is:

1. A surface treated metal member comprising an electrophotographic layer support having a plurality of spherical mark impressions thereon, said impressions having a radius of curvature R and a width D satisfying the relationship $0.035 \leqq D/R$, wherein D is 500 μm or less.

2. A surface treated metal member according to claim 1, wherein the unevenness is formed with impressions having substantially the same radius of curvature and width.

3. A surface treated metal member according to claim 1, wherein the metal member is an aluminum alloy.

4. A surface treated metal member according to claim 3, wherein the aluminum alloy comprises aluminum as the matrix, and the maximum size of the crystal grain comprising aluminum as the matrix sectioned by grain boundaries is 300 μm or less.

5. A surface treated metal member according to claim 3, wherein the aluminum alloy comprises an aluminum matrix with intervening matter including silicon, said silicon being present in the amount of less than 0.5 weight % and the size of the intervening matter being 10 μm or less.

6. A surface treated metal member according to claim 3, wherein the aluminum alloy comprises aluminum as the matrix and has a silicon content of 0.5 to 7 weight %, said member having a Vickers hardness of 50 Hv to 100 Hv.

* * * * *

UNITED STATES PATENT AND TRADEMARK OFFICE

CERTIFICATE OF CORRECTION

PATENT NO. : 4,797,327

DATED : January 10, 1989

INVENTOR(S) : MITSURU HONDA, ET AL.

It is certified that error appears in the above-identified patent and that said Letters Patent is hereby corrected as shown below:

COLUMN 8

Line 3, "carge transfer" should read --charge transfer--.
Line 7, "U.S. Pat. Nos. 4,195,183" should read --U.S. Pat. Nos. 4,395,183--.
Line 22, "contain" should read --may contain--.

COLUMN 14

TABLE 1B, "Example 3 (0.036) 0
Example 4 (0.05) 0"

should read --Example 3 (0.036) 0 ○
Example 4 (0.05) 0 ○--.

COLUMN 20

Line 60, "A(-Mg type aluminum" should read --Al-Mg type aluminum--.

UNITED STATES PATENT AND TRADEMARK OFFICE

CERTIFICATE OF CORRECTION

PATENT NO. : 4,797,327

DATED : January 10, 1989

INVENTOR(S) : MITSURU HONDA, ET AL.

It is certified that error appears in the above-identified patent and that said Letters Patent is hereby corrected as shown below:

COLUMN 22

TABLE 9B, "Example 38 0
(0.036)
Example 39 0
(0.05)
Example 40 0
(0.056)
Example 41 0
(0.07)"

should read --Example 38 0 ○
(0.036)
Example 39 0 ○
(0.05)
Example 40 0 ◎
(0.056)
Example 41 0 ◎
(0.07)--.

UNITED STATES PATENT AND TRADEMARK OFFICE

CERTIFICATE OF CORRECTION

PATENT NO. : 4,797,327

DATED : January 10, 1989

INVENTOR(S) : MITSURU HONDA, ET AL.

It is certified that error appears in the above-identified patent and that said Letters Patent is hereby corrected as shown below:

COLUMN 22

TABLE 9B, "practically good
practically very good"

should read -- ○ practically good
◎ practically very good--.

Signed and Sealed this

Twenty-first Day of August, 1990

*Attest:*

HARRY F. MANBECK, JR.

*Attesting Officer*

*Commissioner of Patents and Trademarks*